US009782979B2

(12) United States Patent
Hattori et al.

(10) Patent No.: US 9,782,979 B2
(45) Date of Patent: Oct. 10, 2017

(54) PRINTER AND RIBBON ROLL

(71) Applicant: TOSHIBA TEC KABUSHIKI KAISHA, Shinagawa-ku, Tokyo (JP)

(72) Inventors: Naoyuki Hattori, Izunokuni Shizuoka (JP); Toshiharu Shimosato, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/258,211

(22) Filed: Sep. 7, 2016

(65) Prior Publication Data

US 2017/0136780 A1 May 18, 2017

(30) Foreign Application Priority Data

Nov. 16, 2015 (JP) ..... 2015-224034

(51) Int. Cl.
*B41J 2/325* (2006.01)
*B41J 32/00* (2006.01)

(52) U.S. Cl.
CPC ..... *B41J 2/325* (2013.01); *B41J 32/00* (2013.01)

(58) Field of Classification Search
CPC ..... B41J 32/00; B41J 2/325
See application file for complete search history.

(56) References Cited

U.S. PATENT DOCUMENTS 6,350,071 B1 * 2/2002 Conwell ..... B41J 2/325 347/102
8,922,611 B1 * 12/2014 Benton ..... B41F 31/027 347/213
9,623,683 B2 * 4/2017 Kojima ..... B41J 13/0009

FOREIGN PATENT DOCUMENTS

JP 2013-169744 9/2013
JP 2014-004803 1/2014

* cited by examiner

*Primary Examiner* — Lamson Nguyen
(74) *Attorney, Agent, or Firm* — Amin, Turocy & Watson LLP

(57) ABSTRACT

A ribbon roll held by a ribbon holder comprises a cylindrical member, an ink ribbon wound around the cylindrical member and a data holding section which is arranged on surface of the cylindrical member and has plural areas where identification codes indicating information relating to the ink ribbon are recorded A driver rotates the cylindrical member held by the ribbon holding section. A detector detects components of the identification code and the mark from a position facing the data holding section of the ribbon roll held by the ribbon holder. A rotation controller enables the driver to rotate the cylindrical member to an extent to which the detector can detect the identification code. A reading controller carries out reading of the identification code by taking the mark as a reference from the components detected by the detector in synchronization with the rotation by the rotation controller.

8 Claims, 9 Drawing Sheets

| | INNER DIAMETER | SENSOR DETECTION POSITION | MINIMUM OUTER DIAMETER | MAXIMUM OUTER DIAMETER |
|---|---|---|---|---|
| DIAMETER | 25.4mm | 29.4mm | 33.4mm | 90.0mm |
| ONE FOURTH PERIPHERY | 19.9mm | 23.1mm | 26.2mm | 70.7mm |
| ONE THIRD PERIPHERY | 26.6mm | 30.8mm | 35.0mm | 94.2mm |
| HALF PERIPHERY | 39.9mm | 46.2mm | 52.4mm | 141.3mm |
| ONE PERIPHERY | 79.8mm | 92.3mm | 104.9mm | 282.6mm |

PRINTER AND RIBBON ROLL

CROSS-REFERENCE TO RELATED APPLICATION

This application is based upon and claims the benefit of priority from Japanese Patent Application No. P2015-224034, filed Nov. 16, 2015, the entire contents of which are incorporated herein by reference.

FIELD

Embodiments described herein relate generally to a printer, a ribbon roll, and associated methods.

BACKGROUND

Conventionally, a printer which prints with an ink ribbon is used. Among such printers, for example, there is a barcode printer.

There are various categories of ink ribbons. The printer prints according to a setting corresponding to the category of the ink ribbon to obtain appropriate printing quality. The category of the ink ribbon is even classified according to manufacture company or lot (unit of manufacture) number in addition to color and width.

Technologies in which the printer automatically recognizes the category of the ink ribbon to automatically select the setting corresponding to the ink ribbon are diversely proposed. Among these technologies, for example, there is a technology which reads information displayed on an end surface of the ink ribbon set in a holding section with a reading device.

It is necessary for such a printer to rotate the ink ribbon once or more while the information displayed on the end surface of the ink ribbon is read. This is because a configuration in which an operator sets an information display position in accordance with the reading device or a configuration for enabling the printer to grasp an information display range is not proposed yet.

Generally, the ink ribbon is conveyed as in printing process in order to rotate a roll of the ink ribbon. Thus, if the foregoing operation is executed, many ink ribbons and sheets are consumed and wasted without being used for their intended purpose (printing), which is not favorable.

DETAILED DESCRIPTION

Figure 1:
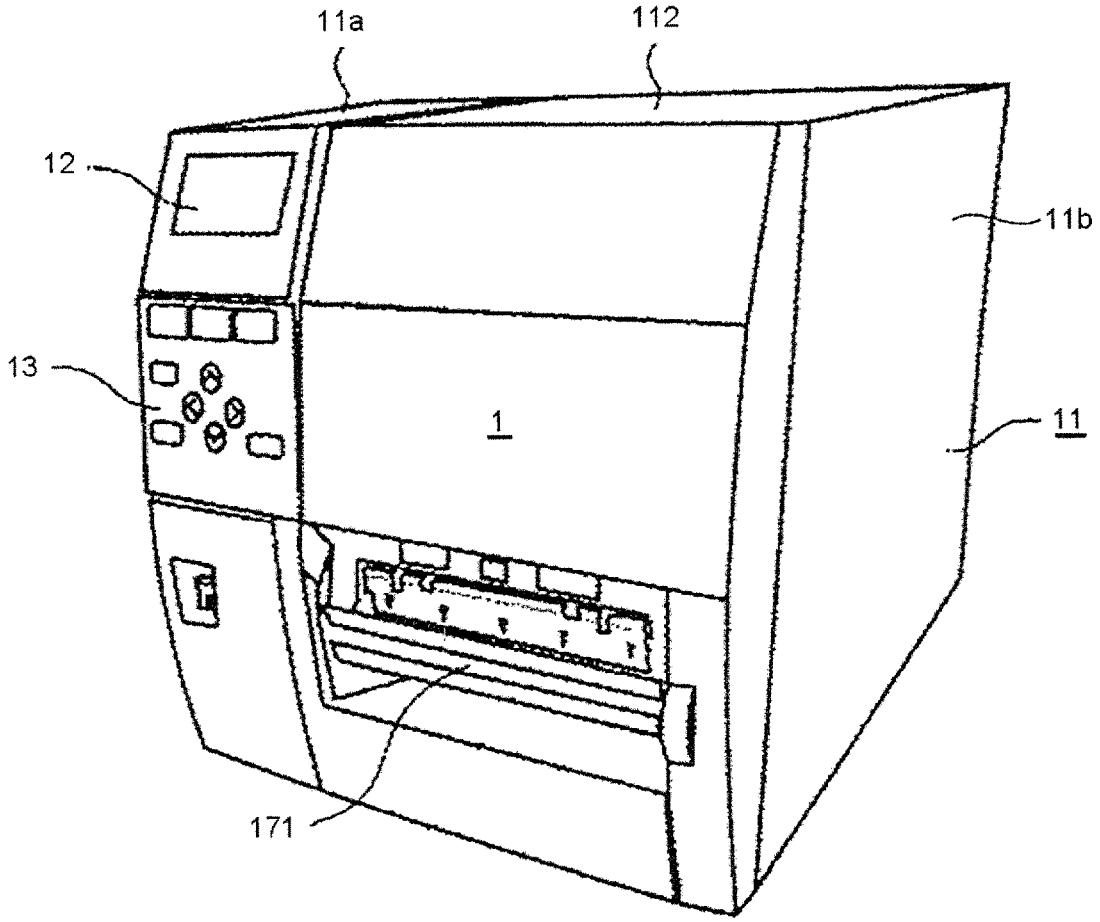
FIG. 1 is a perspective view schematically illustrating the appearance of a printer according to an embodiment.

In accordance with an embodiment, a printer comprises a ribbon holder or ribbon holding section, a driver or driving section, a detector or detection section, a rotation controller or rotation control section and a reading controller or reading control section. The ribbon holding section holds a ribbon roll. The ribbon roll is equipped with a cylindrical member, an ink ribbon wound around the cylindrical member and a data holding section. The data holding section which is arranged on one or both of two end surfaces of the cylindrical member has a plurality of areas in which identification codes indicating information relating to the ink ribbon are recorded and has marks indicating boundaries at the boundaries of the areas. The driving section rotates the cylindrical member held by the ribbon holding section. The detection section detects components of the identification code and the mark from a position facing the data holding section of the ribbon roll held by the ribbon holding section. The rotation control section enables the driving section to rotate the cylindrical member to an extent to which the detection section can detect the identification code. The reading control section carries out reading of the identification code by taking the mark as a reference from the components detected by the detection section in synchronization with the rotation by the rotation control section.

In accordance with another embodiment, a printing method using the ribbon roll involves rotating the cylindrical member to an extent to enable detection of components of the identification code and the mark; and reading the identification code by taking the mark as a reference from the components in synchronization with the rotation.

Hereinafter, embodiments are described with reference to the accompanying drawings. Furthermore, in the drawings described later, the same mark is assigned to the component having the same function, and the repeated description thereof is omitted.

First Embodiment

Figure 2:
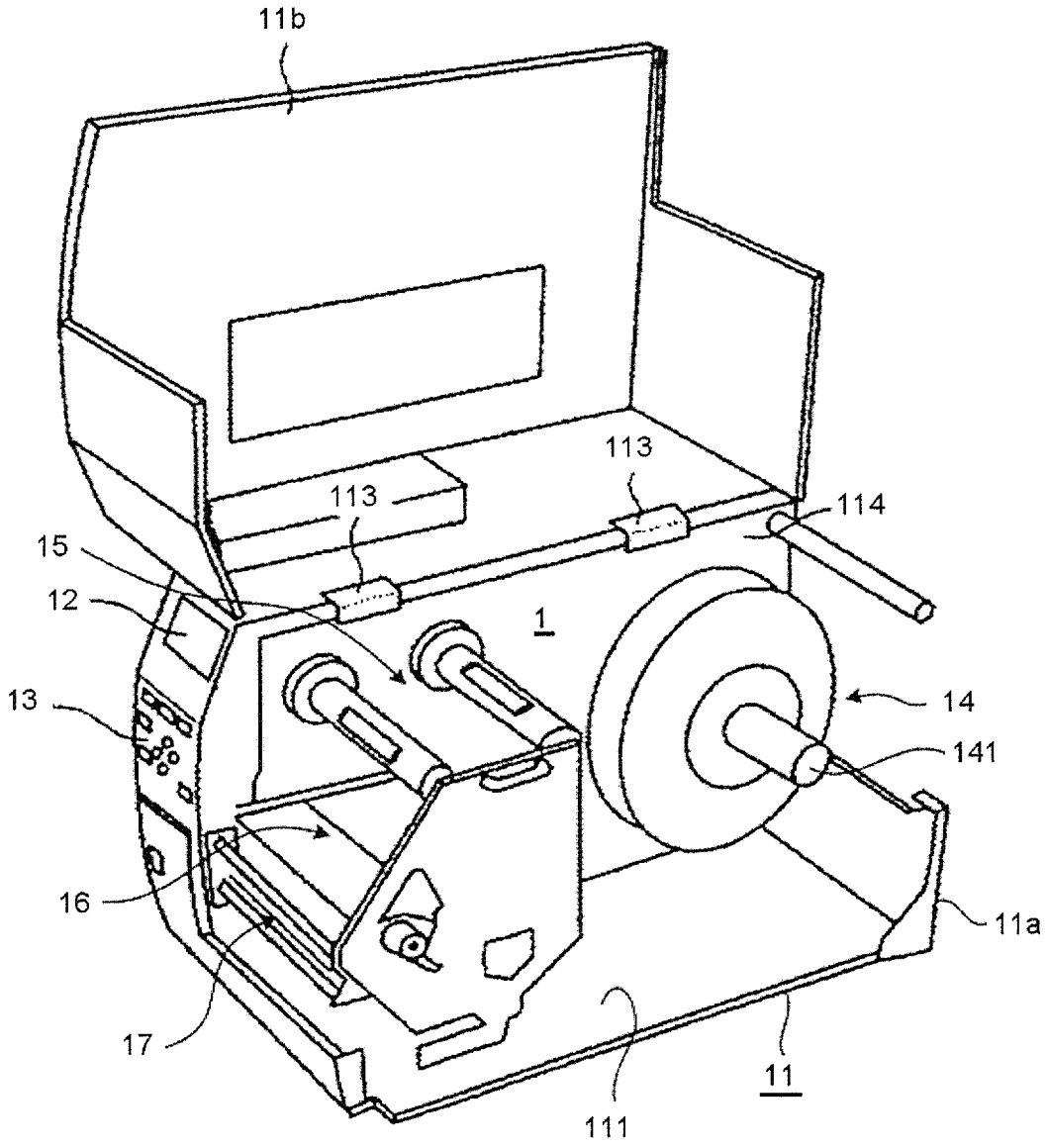
FIG. 2 is a perspective view schematically illustrating a state in which a cover is opened.
Figure 3:
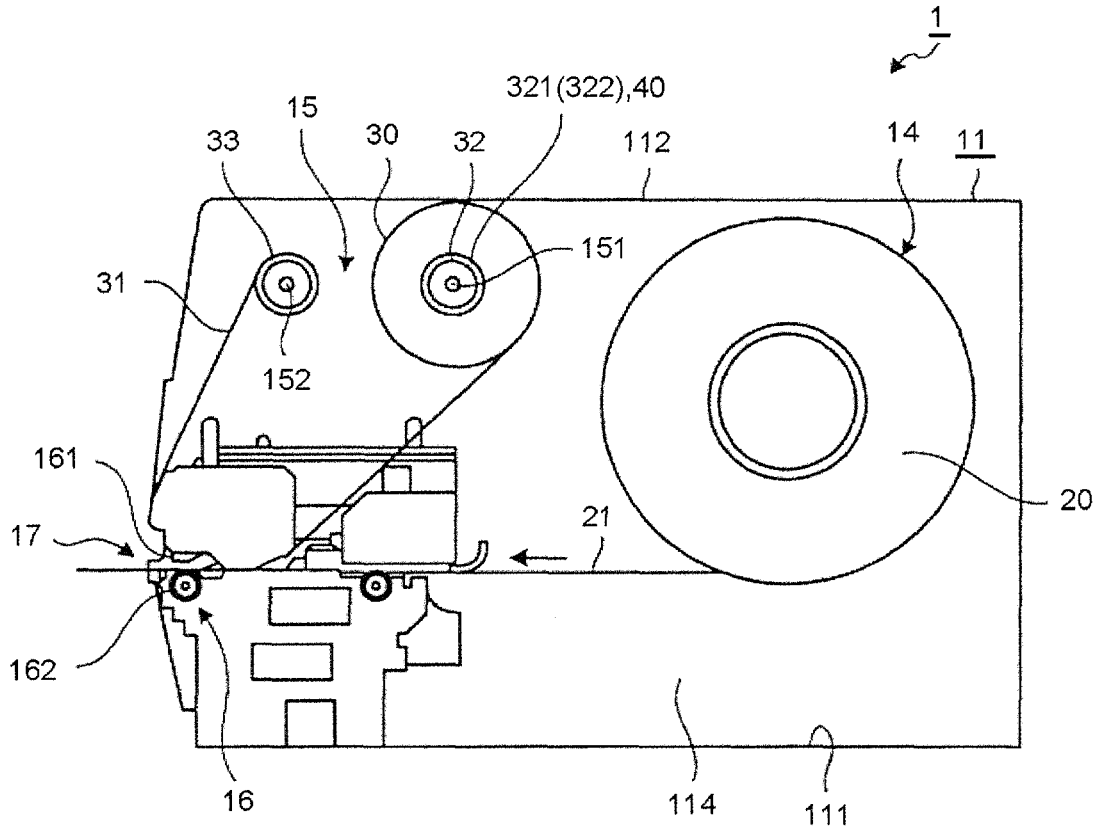
FIG. 3 is a longitudinal section right side view schematically illustrating the inner structure of the printer.

FIG. 1 is a perspective view schematically illustrating the appearance of a printer 1 according to the embodiment; FIG. 2 is a perspective view schematically illustrating a state in which a cover is opened; FIG. 3 is a longitudinal section right side view schematically illustrating the inner structure of the printer 1. The printer 1 according to the present embodiment is a thermal printer.

The printer 1 is equipped with a housing 11, a display section 12, an operation section 13, a sheet holding section 14, a ribbon holding section 15, a printing section 16, and a sheet discharge section 17.

The housing 11 is a box type which can be generally divided right and left into two parts including a left side part 11*a* and a right side part 11*b*. The display section 12 and the operation section 13 are arranged at the front side of the left side part 11*a* of the housing 11. Other sections (the sheet holding section 14, the ribbon holding section 15, the printing section 16 and the sheet discharge section 17) are arranged inside the housing 11.

The left side part 11*a* serving as a main body includes a bottom 111 of the housing 11. The right side part 11*b* is a cover. At an upper surface 112 of the housing 11, one of the left side part 11*a* and the right side part 11*b* is rotatable to the other, and the left side part 11*a* and the right side part 11*b* are connected with each other through a hinge 113.

The housing 11 has a vertical wall 114. The vertical wall 114 is arranged by standing on the bottom 111. The vertical wall 114 holds the foregoing sections (the sheet holding section 14, the ribbon holding section 15 and the printing section 16) mounted on the vertical wall 114.

The display section 12 notifies an operator of an operation state of the printer 1 and an operation reception state by the operation section 13 through displaying characters or marks. The operation section 13 receives various operation input by the operator to the printer 1.

The sheet holding section 14 holds a sheet (print material). In the present embodiment, a rolled paper 20 obtained by winding a belt-like paper 21 is applied as the sheet. The sheet holding section 14 is equipped with a holding shaft 141 arranged in the vertical wall 114 to keep substantially horizontal. The holding shaft 141 holds the rolled paper 20 in a rotatable manner and supports the paper 21 in a drawable manner through being inserted into a hollow part in the center of the winding of the rolled paper 20.

The ribbon holding section 15 holds the ribbon roll 30. The ribbon roll 30 is formed by winding an ink ribbon 31 around an outer peripheral surface of a core (also referred to as a core, or a paper tube) 32 which is a cylindrical member. The ink ribbon 31 is a belt-like medium for holding ink supplied to the paper 21.

The ribbon holding section 15 is equipped with a feeding shaft 151 and a winding shaft 152 which are arranged in the vertical wall 114 and keep substantially horizontal. The feeding shaft 151 rotatably holds the ribbon roll 30 in a state of being inserted into a hollow part of the core 32. The feeding shaft 151 rotates the core 32 to feed the ink ribbon 31 through being rotationally driven by the driving section (described later). The winding shaft 152 is inserted into the hollow part of a winding core 33 which winds the ink ribbon 31 passing through the printing section 16. The winding core 33 is substantially the same as the core 32. The winding shaft 152 rotates the winding core 33 through being rotationally driven by the driving section. One end of the ink ribbon 31 is fixed to the winding core 33, and the winding shaft 152 rotates to wind the ink ribbon 31 around the winding core 33.

Figure 4:
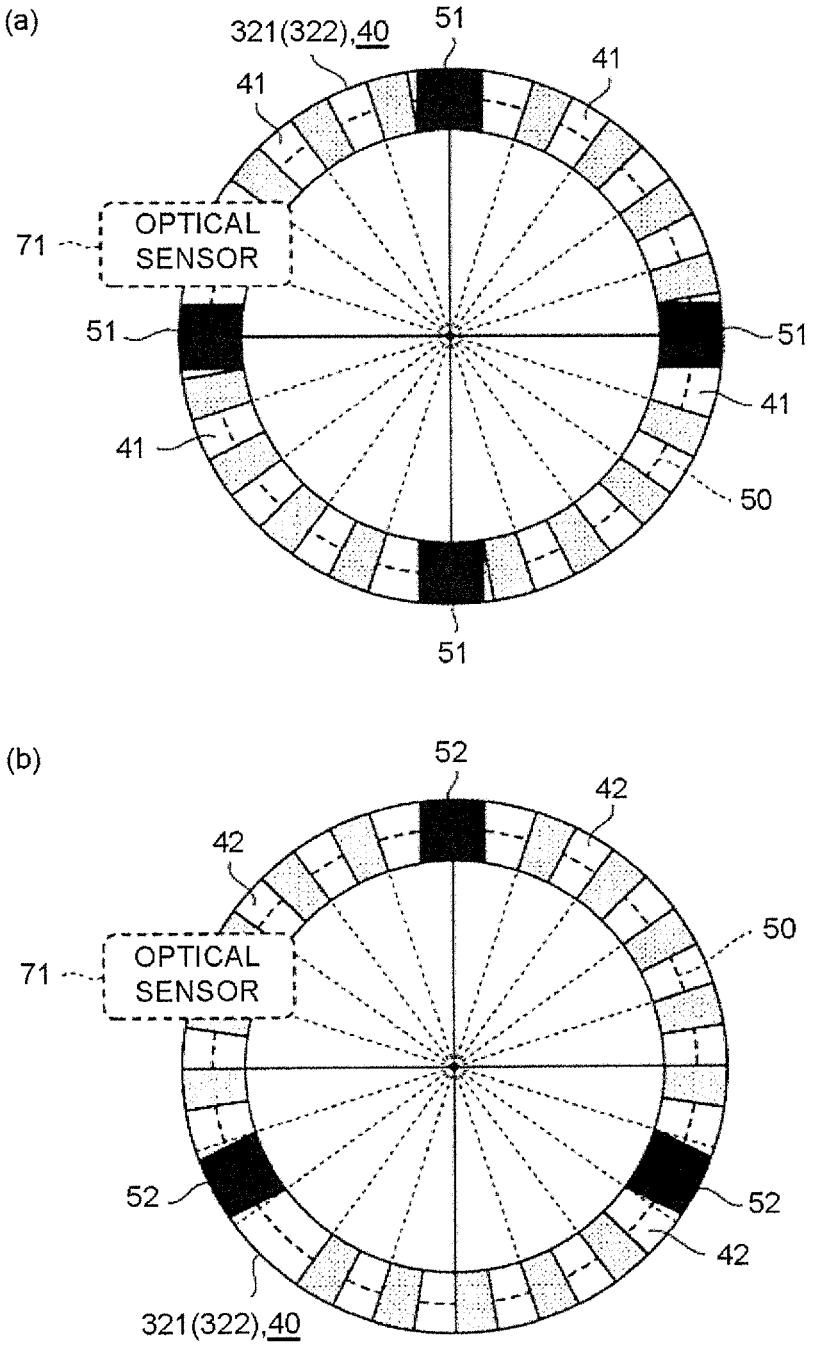
FIG. 4 is a side view illustrating the appearance of a core.

FIG. 4 is a side view illustrating the appearance of the core 32. The data holding sections 40 are arranged on two end surfaces of the core 32 including end surfaces 321 and 322. The data holding section 40 has a plurality of areas in which identification codes indicating information relating to the ink are recorded, and has marks indicating boundaries at the boundaries of the areas. FIG. 4(*a*) shows an example of a case in which the data holding section 40 has four areas 41 and four marks 51, and FIG. 4(*b*) shows an example of a case in which the data holding section 40 has three areas 42 and three marks 52. The identification codes recorded in the areas 41 and 42 are, for example, digital codes of which the black ones and the white ones are alternatively arranged in a circumferential direction. The marks 51 and 52 are, for example, notches.

The number of the arranged areas and marks is not limited to 4 or 3 exemplified above, and may be 2 or 5 as long as the number thereof is determined according to the length of the identification code displayed in the area. In other words, if the identification code is short, the data holding section 40 is divided into short areas (to a degree to which the identification code is settled), and if the number of the arranged areas and marks is large, the convenience is improved (described later in detail). Contrarily, if the identification code is long, the number of the arranged areas and marks becomes small correspondingly.

The printing section 16 carries out printing on the paper 21 with the ink ribbon 31. The printing section 16 is equipped with a thermal head 161 and a platen roller 162. The printing section 16 sandwiches the ink ribbon 31 and the paper 21 between the thermal head 161 and the platen roller 162, and conveys the ink ribbon 31 and the paper 21 through rotation of the platen roller 162. The thermal head 161 heats the ink ribbon 31. The ink contained in the heated part of the ink ribbon 31 is supplied to the paper 21 to carry out the printing operation.

The sheet discharge section 17 discharges the paper 21 after the printing from a sheet discharge port 171 arranged at the front surface of the housing 11.

Figure 5:
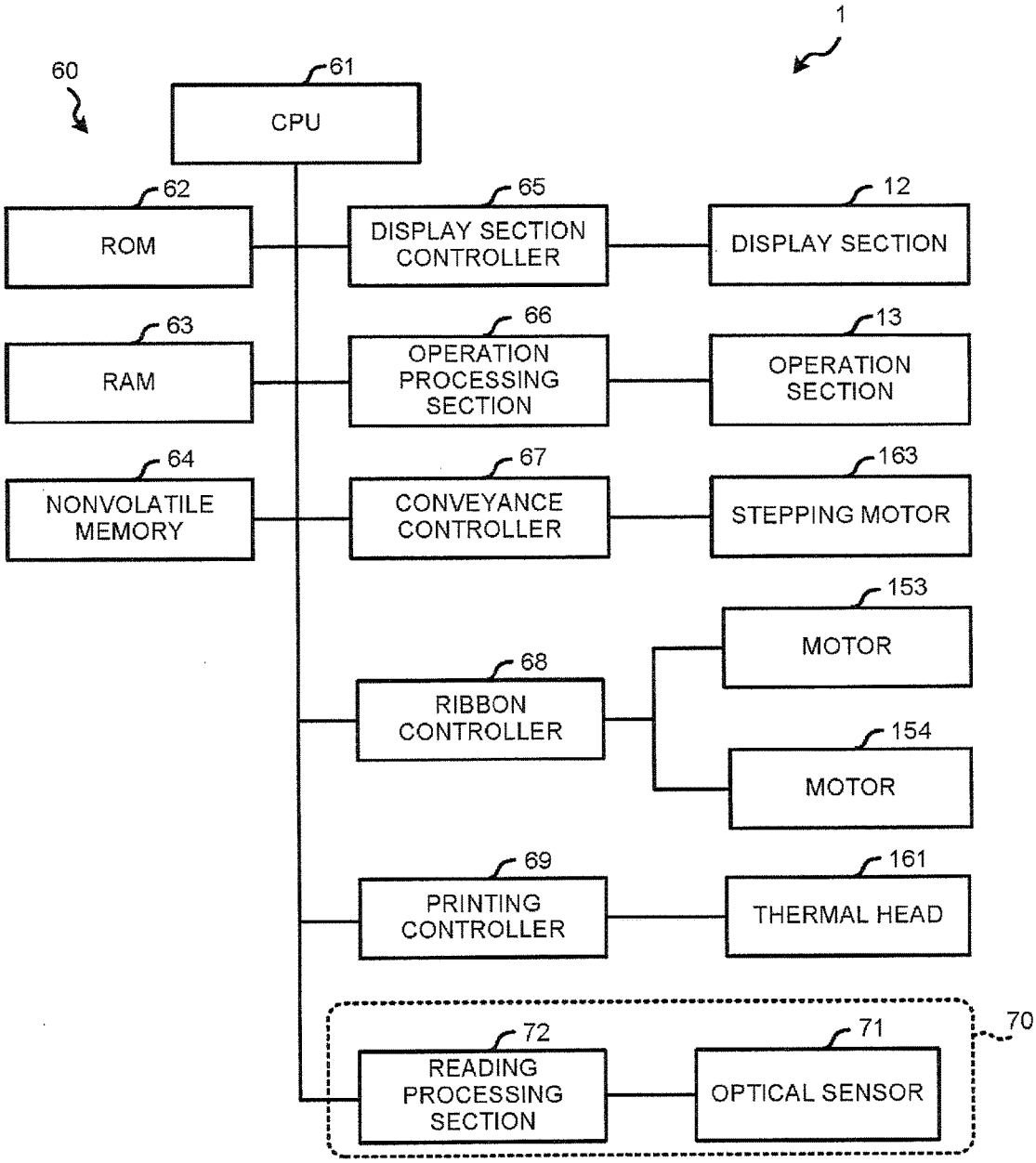
FIG. 5 is a block diagram illustrating the electrical connection of the printer.

The printer 1 is further equipped with a control circuit 60. FIG. 5 is a block diagram illustrating the electrical connection of the printer 1. The control circuit 60 is stored in the back side of the vertical wall 114 in the view of FIG. 3 in the housing 11. The control circuit 60 is equipped with a CPU 61, a ROM 62, a RAM 63, a nonvolatile memory 64, a display section controller 65, an operation processing section 66, a conveyance controller 67, a ribbon controller 68, a printing controller 69 and a detection section 70.

Figure 8:
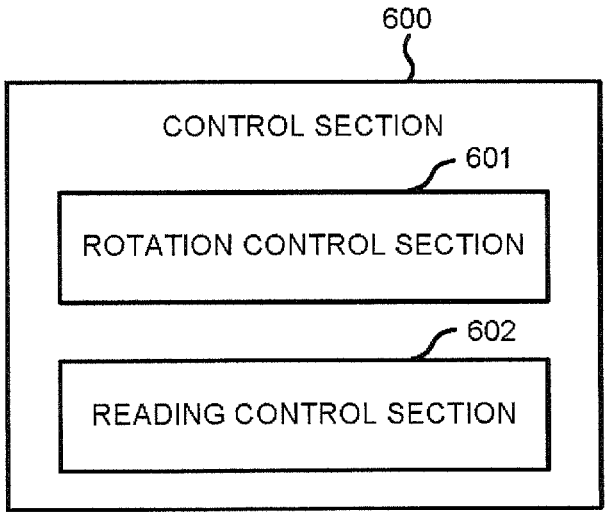
FIG. 8 is a block diagram illustrating functional sections included in a control section.

The CPU (Central Processing Unit) 61, the ROM (Read Only Memory) 62 and the RAM (Random Access Memory) 63 constitute the control section 600 (refer to FIG. 8).

The ROM 62 fixedly stores fixed data (for example, a program executed by the CPU 61 and the like). The RAM 63 stores variable data in a rewritable manner and is used as a working area. Through copying or decompressing a program stored in the ROM 62 on the RAM 63 to execute various arithmetic processing, the CPU 61 collectively controls the foregoing sections (the nonvolatile memory 64, the display section controller 65, the operation processing section 66, the conveyance controller 67, the ribbon controller 68, the printing controller 69 and the detection section 70).

Figures 6, 7:
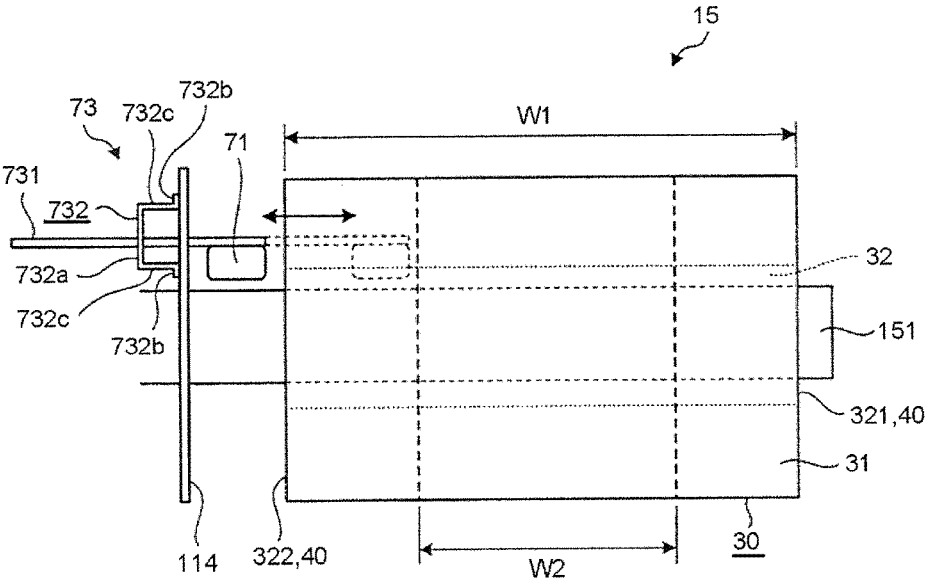
FIG. 6 is a diagram illustrating an example of record contents in a memory, which is obtained by summing up a dimension of each portion of the ribbon roll in a form of a table.
FIG. 7 is a diagram illustrating an arrangement state of an optical sensor.

The nonvolatile memory (hereinafter, simply referred to a memory) 64 which is a readable/writable nonvolatile storage medium stores various programs executed by the CPU 61 and various data. As the data stored in the memory 64, for example, there is a dimension of the ribbon roll 30 used by the printer 1 and the like. FIG. 6 is a diagram illustrating an example of record contents in the memory 64, which is obtained by summing up a dimension of each portion of the ribbon roll 30 in a form of a table.

The memory 64 stores an inner diameter and maximum value and minimum value of an outer diameter of the ribbon roll 30 and a sensor detection position (indicated by the dotted line with a mark 50 in FIG. 4). The inner diameter of the ribbon roll 30 is the inner diameter of the core 32. The maximum value of the outer diameter of the ribbon roll 30 is the value of the outer diameter of the ink ribbon 31 wound around the core 32 of the ribbon roll 30 in an unused state. The minimum value of the outer diameter of the ribbon roll 30 is the outer diameter of the core 32.

Further, the memory 64 records various lengths of peripheries (one periphery, half periphery, one third periphery and one fourth periphery) corresponding to the foregoing each dimension.

The display section controller 65 controls display content of the display section 12 under the control of the control section 600. The operation processing section 66 transmits the display content to the control section 600 in response to the signal output by the operation section 13.

The printing section 16 is further equipped with a stepping motor 163 for rotating the platen roller 162. The stepping motor 163 and the platen roller 162 constitute a conveyance section (not shown) for conveying the paper 21 and the ink ribbon 31.

The stepping motor 163 receives input of a pulse signal output by the conveyance controller 67 to rotate only by a rotation angle corresponding to the pulse number. Resolution of the printing section 16 is, for example, 200 dot/inch. The stepping motor 163 rotates corresponding to one pulse to convey the paper 21 and the ink ribbon 31 only at a length corresponding to 1 dot. Thus, the stepping motor 163 receives 200 pluses to convey the paper 21 and the ink ribbon 31 by one inch.

Under the control of the control section 600, the conveyance controller 67 manages the driving of the stepping motor 163 so as to manage conveyance amount of the paper 21 and the ink ribbon 31. More specifically, the conveyance controller 67 sends the pulse signal to the stepping motor 163 based on the control of the control section 600.

Furthermore, the ribbon holding section 15 is further equipped with a motor 153 for rotating the feeding shaft 151 and a motor 154 for rotating the winding shaft 152. The motors 153 and 154 are, for example, DC motors. The motors 153 and 154 and the foregoing conveyance section function as a driving section (symbol of which is not shown) for rotating the core 32 of the ribbon roll 30.

The ribbon controller 68 controls the driving of the motors 153 and 154. The motor 153 and the motor 154 rotate the feeding shaft 151 and the winding shaft 152 based on the control of the ribbon controller 68 in such a manner that the ink ribbon 31 conveyed by the conveyance section is stretched at a proper tension.

A slit sensor (not shown) is used in the control of the foregoing motors 153 and 154. The slit sensor detects a slit of a rotary disk (not shown) which rotates along with the feeding shaft 151 (the winding shaft 152). The slit is arranged in a radiation direction from a rotation center of the rotary disk. The ribbon controller 68 stops the motor 153 (154) if the slit sensor changes from a state of regularly detecting the slit to a state of not detecting the slit.

The printing controller 69 controls the energization to the thermal head 161 based on the instruction of the control section 600.

The detection section 70 which is equipped with an optical sensor 71 and a reading processing section 72 detects components of the identification code and the marks 51 and 52. The components of the identification code according to the present embodiment are black color and white color alternatively arranged. Further, the components of the marks 51 and 52 are notches.

The optical sensor 71 is arranged at a position facing the data holding section 40 to irradiate the identification code and the mark 51 and 52 with light and outputs a signal based on the reflected light to the reading processing section 72. The levels of the signals output by the optical sensor 71 are different according to the notch, the black color and the white color.

The reading processing section 72 outputs a detection instruction to the optical sensor 71 according to the control of the control section 600. Further, the reading processing section 72 generates (A/D converts) a digital signal based on an analog signal input from the optical sensor 71 to output the digital signal to the control section 600.

FIG. 7 is a diagram illustrating an arrangement state of the optical sensor 71. In general, even though there is a variety of the widths of the ribbon rolls 30 determined to be used in one printer 1, the diameters of the cores 32 thereof are the same. In a case of centering the mounting position of the ribbon roll 30, the suitable position of the optical sensor 71 changes depending on the category of the width. In FIG. 7, the positions of the optical sensor 71 corresponding to two categories including widths W1 and W2 are shown as an example.

In order to read the identification code recorded on the end surfaces 321 and 322 of the core 32 of each of various kinds of the ribbon rolls 30, it is desirable that the optical sensor 71 can move along a width direction of the ribbon roll 30. Thus, the detection section 70 is equipped with a sensor supporting section (supporting section) 73 for movably supporting the optical sensor 71 along the width direction of the ribbon roll 30.

The sensor supporting section 73 is equipped with a slide shaft 731 and a supporting member 732. The slide shaft 731 is arranged in such a manner that the longitudinal direction thereof is coincident with the width direction of the ribbon roll 30, and the optical sensor 71 is arranged at one end of the slide shaft 731. The supporting member 732 is used to support the slide shaft 731. The supporting member 732 which is a sheet metal folded into a crank shape includes a shaft supporting surface 732*a*, a mounting surface 732*b* and a connecting surface 732*c*.

The shaft supporting surface 732*a* is substantially parallel to the vertical wall 114, and has a hole (not shown) penetrating the slide shaft 731. The mounting surfaces 732*b* are located at two end parts of the supporting member 732 and are mounted in the vertical wall 114 in parallel with the shaft supporting surface 732*a*. The connecting surface 732*c* is arranged between the shaft supporting surface 732*a* and the mounting surface 732*b* to connect them.

The other end part of the slide shaft 731 slidably penetrates the shaft supporting surface 732*a* and the vertical wall 114. In this way, the position of the optical sensor 71 arranged at one end of the slide shaft 731 can be changed corresponding to positions of the end surfaces 321 and 322 of each of various cores 32.

FIG. 8 is a block diagram illustrating functional sections included in the control section 100. The CPU 61 copies or decompresses the program stored in the ROM 62 on the RAM 63 to execute the program so that the control section 600 functions as a rotation control section 601 and a reading control section 602.

The rotation control section 601 rotates the core 32 with the driving section only to an extent to which the identification code can be detected by the detection section 70. The extent to which the detection section 70 can detect the identification code refers to an angle equal to or greater than an angle equivalent to that between the two marks 51 sandwiching one area 41 and is smaller than one revolution.

The reading control section 602 carries out the reading of the identification code in synchronization with the foregoing rotation. More specifically, the reading control section 602 enables the detection section 70 to detect the components of the identification code and the mark 51 in synchronization with the foregoing rotation. Then, the reading control section 602 takes the mark 51 as a reference to read the identification code from the digital signal input from the detection section 70.

Figure 9:
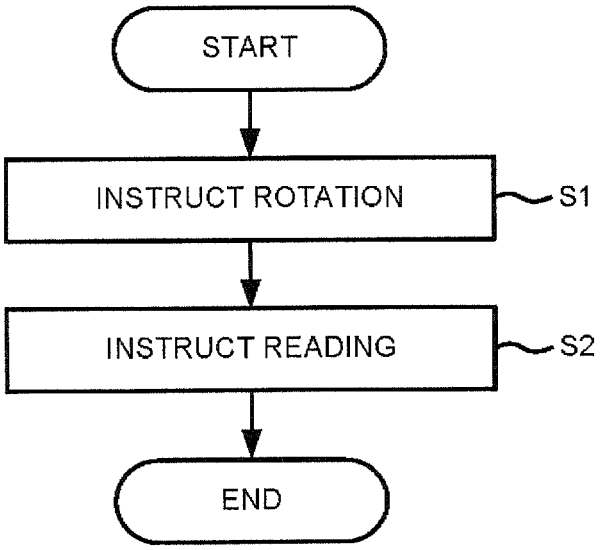
FIG. 9 is flowchart illustrating the flow of a processing executed by a rotation control section and a reading control section at the time of automatically recognizing a category of the ink ribbon.

FIG. 9 is flowchart illustrating the flow of a processing executed by the rotation control section 601 and the reading control section 602 at the time of automatically recognizing the category of the ink ribbon 31. The rotation control section 601 instructs the stepping motor 163 to convey the ink ribbon 31 via the conveyance controller 67 (ACT S1). Along with that, the control section 600 instructs the motors 153 and 154 to rotate the feeding shaft 151 and the winding shaft 152 via the ribbon controller 68. In this way, the core 32 and the winding core 33 rotate. In synchronization with the rotation, the reading control section 602 instructs the reading processing section 72 to detect the components of the identification code and the mark 51 in the data holding section 40 (ACT S2).

Figure 10:
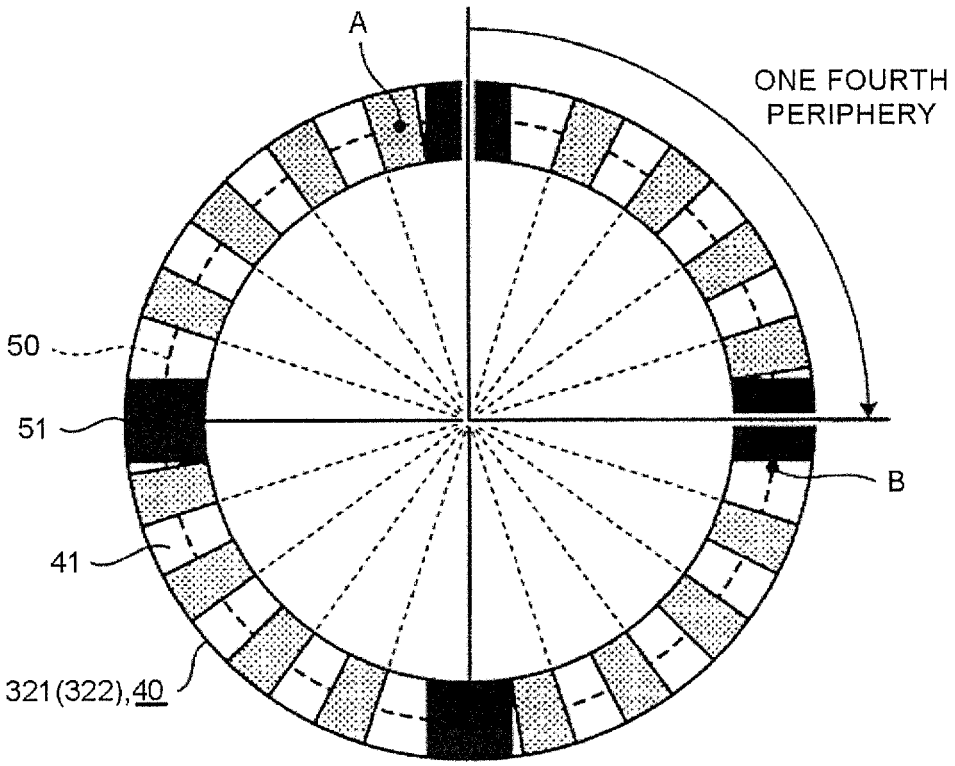
FIG. 10 is a diagram illustrating one control method by the rotation control section and the reading control section.

FIG. 10 is a diagram illustrating one control method by the rotation control section 601 and the reading control section 602. Herein, a case in which the rolled paper 20 used in the printer 1 has four areas 41 in the data holding section 40 is exemplified.

The rotation control section 601 enables the driving section to rotate the ribbon roll 30 until the detection section 70 detects the two marks 51. If the rotation from a point A in the data holding section 40 of the ribbon roll 30 is started, the rotation control section 601 continues the rotation until a point B. As a result, one area 41 is necessarily contained in the rotation range.

According to such a method, even the maximum length of the ink ribbon 31 consumed for the automatic recognition of the category is equivalent to half periphery at the time of the maximum outer diameter of the ribbon roll 30. Thus, for example, in the case of the ribbon roll 30 with a dimension shown in FIG. 6, compared with a conventional method of rotating one revolution or more, the ink ribbon 31 of 141.3 mm or more can be saved.

Figure 11:
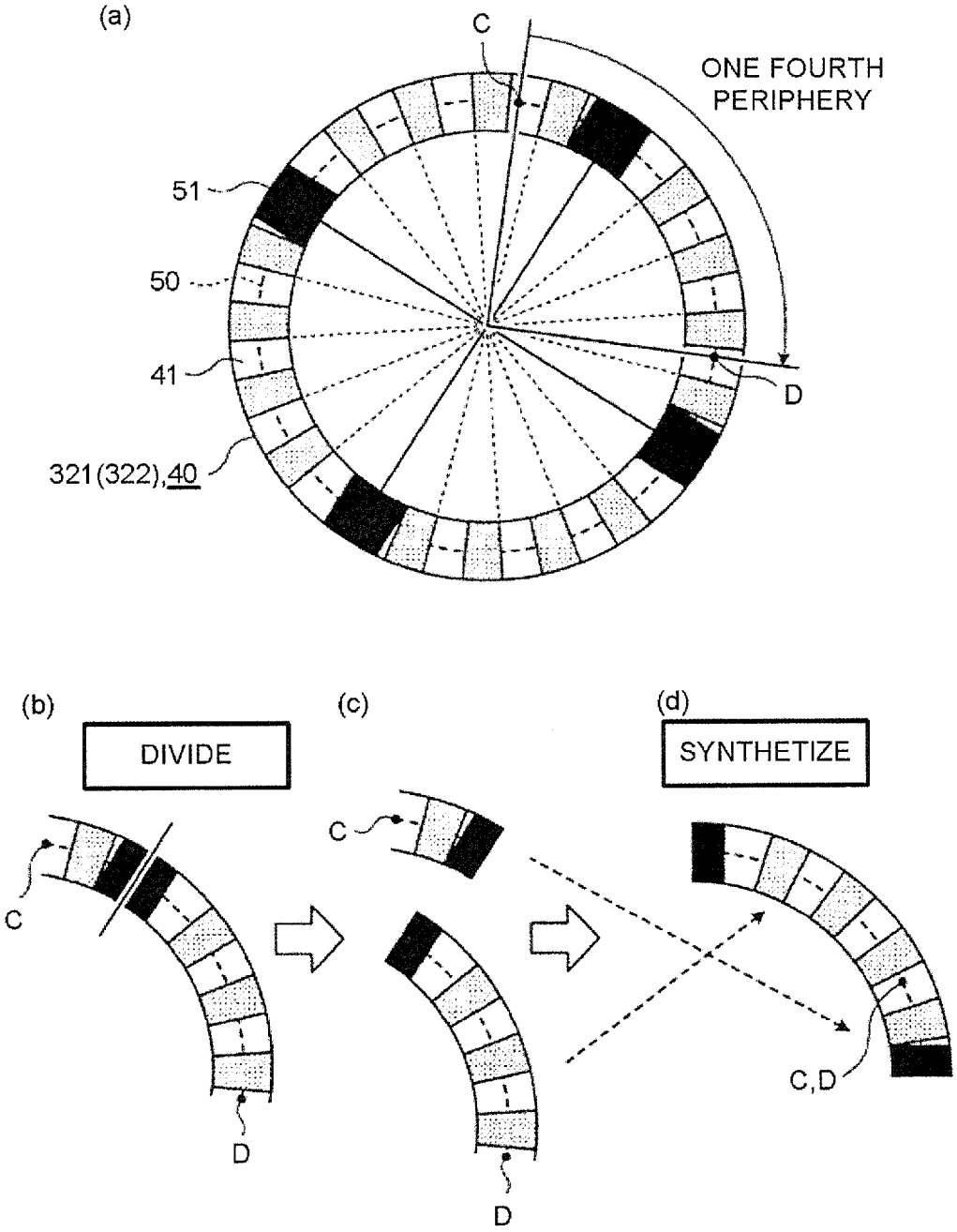
FIG. 11 is a diagram illustrating another control method by the rotation control section and the reading control section.

FIG. 11 is a diagram illustrating another control method by the rotation control section 601 and the reading control section 602. Herein, a case in which the rolled paper 20 used in the printer 1 has four areas 41 in the data holding section 40 is exemplified.

The rotation control section 601 refers to the memory 64 to grasp the length of the ink ribbon 31 equivalent to one fourth periphery at the time of the maximum outer diameter of the ribbon roll 30 to calculate the pulse number equivalent to the length.

The pulse number refers to the number of pulse signals delivered to the stepping motor 163. The value is obtained when the lengths of the ink ribbon 31 and the paper 21 conveyed by the platen roller 162 become substantially identical to one fourth periphery at the time of the maximum outer diameter of the ribbon roll 30.

Next, the rotation control section 601 applies the pulse signal the number of which is only identical to the calculated pulse number to the stepping motor 163 to convey the ink ribbon 31 and rotates the ribbon roll 30. If the rotation from a point C in the data holding section 40 of the ribbon roll 30 is started, the rotation control section 601 continues the rotation until a point D (refer to FIG. 11(*a*)).

Supposedly, if the point C is located on the mark 51, as the point D is located on the next mark 51, just one identification code exists between the two points C and D.

As shown in FIG. 11(*a*), if the point C is located in the identification code, the point D is located in the next identification code passing through the mark 51. In this case, the point C and the point D are located at the same positions of the identification codes recorded indifferent locations of the data holding section 40.

In this case, the reading control section 602 first identifies the location equivalent to the mark 51 from the output of the detection section 70. Next, the reading control section 602 cuts (refer to FIG. 11(*b*)) the output at the location equivalent to the mark 51 to bisect the output (refer to FIG. 11(*c*)). Then, the front one and rear one are switched in such a manner that the one formerly read (detected) is placed back so that the two are connected (synthetized) to be one (refer to FIG. 11(*d*)). In other words, the two parts are connected in such a manner that the bisected mark 51 is located outside and the point C and the point P are combined. In this way, one identification on code is obtained.

According to such a method, even the maximum length of the ink ribbon 31 consumed for the automatic recognition of the category is equivalent to one fourth periphery at the time of the maximum outer diameter of the ribbon roll 30. Thus, for example, in the case of the ribbon roll 30 with a dimension shown in FIG. 6, compared with a conventional method of rotating one revolution or more, the ink ribbon 31 of 212.0 mm or more can be saved.

Through the above, according to the present embodiment, the automatic recognition of the category of the ink ribbon 31 can be realized while the consumption of the ink ribbon 31 is suppressed.

Further, in the present embodiment, the data holding sections 40 are arranged on the two end surfaces 321 and 322; however, in the implementation, the arrangement of the data holding section 40 is not limited to this. For example, the data holding section 40 may be arranged on either of the end surfaces (321 and 322) located at a side at which the data holding section 40 can be detected by the optical sensor 71.

Further, in the present embodiment, the motors 153 and 154 are described as the DC motors, for example. However, in the implementation, the motors 153 and 154 may be stepping motors. Further, if the ribbon roll 30 is light enough to be sent through only force by the conveyance section, the motors 153 and 154 may not be arranged.

Further, in the implementation, the marks 51 and 52 are not limited to notches. In the present embodiment, the marks 51 and 52 are set as notches, when the black part of the identification code is detected, a voltage level difference occurs in the output of the optical sensor 71. In this way, the distinction by the optical sensor 71 between the marks 51 and 52 and the black part of the identification code is clear. However, in the implementation, for example, the marks 51 and 52 may be represented through being set to the black color (or white color) with the lengths which are not contained in the identification code other than the notches. In this case, whether the black color is the marks 51 and 52 or the identification code is distinguished according to the time spent in detection executed by the optical sensor 71.

In the foregoing embodiment, the identification code is represented by color (intensity); however, in the implementation, it is not limited to this. For example, the identification code and the marks 51 and 52 may be represented according to unevenness formed on the end surfaces 321 and 322 of the core 32.

Further, in the implementation, the detection section 70 may also use other devices than the optical sensor 71 as long as the components of the identification code and the marks 51 and 52 can be detected.

In the present embodiment, the paper 21 is exemplified as the print material; however, in the implementation, the print material may be a sheet made from other materials such as plastic other than the paper.

(First Modification)

In the present modification, the control method by the rotation control section 601 and the reading control section 602 in a case in which at least the motor 153 between the motors 153 and 154 in the foregoing embodiment is the stepping motor is described. In the present modification, the rotation control section 601 rotates the core 32 by the motor 153 without carrying out conveyance by the conveyance section. Along with rotation, the reading control section 602 carries out the reading of the identification code with the method described with reference to FIG. 11.

The rotation control section 601 reversely rotates the core 32 to an extent to which the core 32 rotates in the detection after the detection section 70 completes the detection of the components of the identification code. In other words, the core 32 is rotated in a reverse direction of the rotation direction in the detection.

In the present modification, in a case in which the ribbon roll 30 has the dimension shown in FIG. 6, the ink ribbon 31 of 70.7 mm slackens in the front of the printing section 16. However, as the slackened ink ribbon 31 is very short, even though the part slackened once is utilized in the printing by reversely rotating the motor 153 to rewind the ink ribbon 31, the probability that the bad influence is applied to the printing quality is low. In this way, the waste of the ink ribbon 31 and the paper 21 can be further eliminated.

(Second Modification)

In the present modification, a case in which the motor 153 in the first modification is the DC motor is described. In the present modification, similar to the first modification, based on the premise that the slackening of the ink ribbon 31 is rewound, it is possible to carry out the reading by rotating the core 32 with the motor 153. In this case, the reading of the identification code can be realized with the method described with reference to FIG. 10. In other words, the rotation control section 601 stops the motor 153 and reverses the motor 153 to rewind the ink ribbon 31 although the optical sensor 71 detects a plurality of the marks 51.

(Third Modification)

In the foregoing embodiment and the modifications, the motors 153 and 154 are arranged separate from the stepping motor 163; however, in the implementation, it is not limited to this. Various motors may be standardized through transmitting the driving of the stepping motor 163 constituting the conveyance section via a gear and the like.

In other words, each part may be driven by the single stepping motor 163. In this way, without using other stepping motors in the rotation of the feeding shaft 151, the rotation angle of the core 32 can be accurate. Thus, through the configuration, the reading of the identification code can be executed with the method described with reference to the FIG. 11.

With respect to any figure or numerical range for a given characteristic, a figure or a parameter from one range may be combined with another figure or a parameter from a different range for the same characteristic to generate a numerical range.

Other than in the operating examples, or where otherwise indicated, all numbers, values and/or expressions referring to quantities used in the specification and claims are to be understood as modified in all instances by the term "about."

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer, comprising:

a ribbon holder configured to hold a ribbon roll comprising a cylindrical member, an ink ribbon wound around the cylindrical member and a data holding section arranged on one or both of two end surfaces of the cylindrical member and having a plurality of areas in which identification codes indicating information relating to the ink ribbon are recorded and marks indicating boundaries at the boundaries of the areas;

a driver configured to rotate the cylindrical member held by the ribbon holder;

a detector configured to detect components of the identification code and the mark from a position facing the data holding section of the ribbon roll held by the ribbon holder;

a rotation controller configured to enable the driver to rotate the cylindrical member to an extent to which the detector can detect the identification code; and a reading controller configured to carryout reading of the identification code by taking the mark as a reference from the components detected by the detector in synchronization with the rotation by the rotation controller.

2. The printer according to claim 1, wherein the rotation controller enables the driver to continue rotation of the cylindrical member from a time the rotation of the cylindrical member by the driver is started to a time the detector detects two marks.

3. The printer according to claim 1, wherein the rotation controller rotates the cylindrical member with the driver at an angle equivalent to that between the two marks sandwiching one area; and the reading controller divides detection result according to the former mark and the latter mark detected by the detector and switch the former mark and the latter mark to connect them to synthetize the identification code.

4. The printer according to claim 1, wherein the rotation controller rotates the cylindrical member in a reverse direction of a rotation direction in the detection after the detection by the detector is completed to rewind the ink ribbon sent from the ribbon roll through the rotation relating to the detection.

5. The printer according to claim 1, wherein the marks comprise notches.

6. The printer according to claim 1, wherein the identification code is represented by color.

7. The printer according to claim 1, wherein the ribbon roll comprises 2 to 5 marks.

8. The printer according to claim 1, wherein the ribbon roll comprises 2 to 5 identification codes.

* * * * *